United States Patent [19]

Chiang

[11] Patent Number: 4,660,364

[45] Date of Patent: Apr. 28, 1987

[54] RACKET STRING CONSTRUCTION

[75] Inventor: Chinn-Chann Chiang, Austin, Tex.

[73] Assignee: Alpha Sports, Inc., Austin, Tex.

[21] Appl. No.: 757,492

[22] Filed: Jul. 22, 1985

[51] Int. Cl.[4] ..... D02G 3/22; D02G 3/40; D02G 3/44

[52] U.S. Cl. ..... 57/234; 57/210; 57/251

[58] Field of Search ..... 57/3, 6, 7, 13, 200, 57/210, 212, 213, 216, 217, 222–225, 230, 232, 243, 244, 250, 251

[56] References Cited

U.S. PATENT DOCUMENTS

| | | | |
|---|---|---|---|
| 2,181,475 | 11/1939 | Bourbon | 57/230 X |
| 3,605,399 | 9/1971 | Rijswik et al. | 57/234 |
| 3,745,756 | 7/1973 | Crandall | 57/7 X |
| 4,016,714 | 4/1977 | Crandall et al. | 57/234 |
| 4,275,117 | 6/1981 | Crandall | 57/250 X |
| 4,530,206 | 7/1985 | Benichou et al. | 57/244 X |

*Primary Examiner*—Donald Watkins

*Attorney, Agent, or Firm*—Antonelli, Terry & Wands

[57] ABSTRACT

Athletic racket string construction consisting of a seven strand core and an outer layer of wrapping fibers.

12 Claims, 2 Drawing Figures

RACKET STRING CONSTRUCTION

BACKGROUND OF THE INVENTION

The present invention relates to athletic racket string construction and, more particularly, to a synthetic racket string construction having a seven strand core and an outer layer of wrapping fibers, especially ally in oversized racket applications where the string diameter is between 1.26 mm and 1.45 mm to achieve the desired strength.

The earliest strings used in tennis rackets was natural gut made from animal fibers. Tennis players found and still find natural gut to be acceptable because of its good tensile modulus which produces excellent elasticity and resilience. The good tensile modulus of natural gut has been attributed, at least in part, to its multi-fiber structure.

However, natural gut is not without disadvantages, and these disadvantages discourage its wide use. For instance, natural gut is not humidity proof. On one hand, it becomes sticky at its surface and stretches easily when wet. On the other hand, natural gut contracts when it is dry. Thus, it will be readily appreciated that a natural gut strung in a racket frame when stretched under high humidity conditions may break under dry conditions due to contraction.

Natural gut also frays easily and is not particularly durable. It has a relatively low breaking strength with only little room for improvement. The sources of animal fiber are also becoming limited; in turn, this results in higher prices. As shown in U.S. Pat. No. 1,669,212, attempts were made to improve the performance of natural gut by spirally winding it around a rubber core with such tightness as to hold the core under a certain amount of initial compression to be augmented when the string is tensioned to increase the resiliency lengthwise of the string and increase elasticity transversely of the string.

Given the tremendous rise and popularity in racket sports such as tennis, racketball and squash, it was inevitable that racket manufacturers would turn to an alternative and cheaper substitute. The development of synthetic fiber caused a large scale use of synthetic fibers in rackets. For background purposes, synthetic string suitable for this purpose can be generally grouped into two categories, i.e., a string with a center core and a string without a center core.

The center core string primarily consist of a large diameter core wrapped with smaller diameter fibers. The core diameter usually ranges from 0.8 mm to 1.0 mm depending on the desired string guage. The wrapped fibers have a diameter of between about 0.16 mm and 0.25 mm. The manner in which the fibers are wrapped around the core, as well as the materials used for the center core and the wrapping fibers, will vary depending on the desired characteristics of the string.

The center core synthetic string offers the advantages of being humidity proof, durable and relatively inexpensive. Nevertheless, it has been found that one problem with this type of string is that, due to a larger than desirable cross section for the center core the string becomes relatively stiff. Furthermore, it is known that the tensile strength per unit cross section decreases when the cross section of a synthetic fiber exceeds a certain value, the value depending on the fibers involved. In general, however, when the diameter exceeds 0.40 mm to 0.60 mm, the tensile strength per unit cross section decreases fairly rapidly. Thus, manufacturers are forced to use larger cross section for the center core to obtain the necessary total tensile strength sufficient for tennis rackets, particularly oversized tennis rackets. This has the unfortunate effect of increasing the stiffness of the string and lowering the playability of the racket even though the string becomes more durable in the process.

To avoid the foregoing disadvantages of the center core synthetic string, it has been proposed to use a string without a center core. To this end, a bunch of fibers are twisted together and then properly treated at the surface of the bunch of fibers. I believe it is fair to say that the choice of the number of fibers to be twisted together is usually rather arbitrary. For example, it has been known to use between 51 to 53 fibers in a string without a center core. Some manufacturers use as many as 1400 twisted fibers.

It has been found that if too many fibers are twisted together, the string becomes easily frayed as is the case with natural gut. More. over, it is hard to twist too many fibers together in a geometrically stable fashion. For instance, sometimes cavities result among the twisted fibers, and this makes the string easier to fray, thereby decreasing durability of the string. By the same token, if too few fibers are used, e.g. three, the desired characteristic features of natural gut string will be missing.

Various examples of prior art string are shown in U.S. Pat. Nos. 1,669,212; 2,181,475; 3,329,061, 3,745,756; 4,016,714; 4,084,399; 4,159,618, and 4,275,117.

SUMMARY OF THE INVENTION

It is a main object of my invention to provide a synthetic racket string which combines the advantages of a natural gut string, center core synthetic string and a synthetic string without a center core.

More particularly, I have found that the disadvantages of conventional synthetic strings can be overcome by using instead of a monofilament core a multi-strand core with a stable and regular cross section. The core is then wrapped with monofilament fibers as is the case of a string with a center core.

I have also discovered that to achieve the advantages of a center core string and a non-center core string, seven strands must be used in the core. Furthermore, I have also found that the diameter of the strands for the core should be approximately twice the diameter of the wrapping fibers.

The foregoing construction of a synthetic racket string results in a string which has the advantages of a coreless string even though there is a seven strand pseudo-core. It provides a high straight and knot tensile strength.

My invention thus results in a string which can be constructed relatively thin, e.g. 1.26 mm diameter, which is strong enough for an oversized tennis racket even though the diameter of conventional tennis racket string ranges from 1.26 mm to about 1.5 mm.

It is thus another advantage of my invention that the player can use a 1.26 mm diameter string made of nylon instead of polyester which has less elasticity and resilience.

Another feature of my invention is that the number of fibers used in wrapping the seven strand pseudo-core is about twenty. The number of fibers will depend on the cross section of the entire string or, alternatively, on the cross section of the seven strand pseudo-core.

Another feature of my invention is that the seven strand pseudo-core core results in the most stable regular geometrical structure having a relatively high tensile strength per unit cross-section which results in a high total tensile strength.

Another advantage of my invention is that the combination of a seven strand core and an outer wrapping layer minimizes the possible fraying of the synthetic string while providing ideal, durable gut-like features.

Another feature of my invention is that the string can be constructed of readily available nylon 6 or nylon 66 instead of special materials, such as polyester.

DESCRIPTION OF THE DRAWINGS

These and further features, objects and advantages of my invention tion will become readily apparent from the following detailed description of a preferred embodiment when taken in conjunction with the accompanying drawing which shows, for purposes of illustration only, a preferred embodiment and wherein.

DETAILED DESCRIPTION OF A PREFERRED EMBODIMENT

Figure 1:
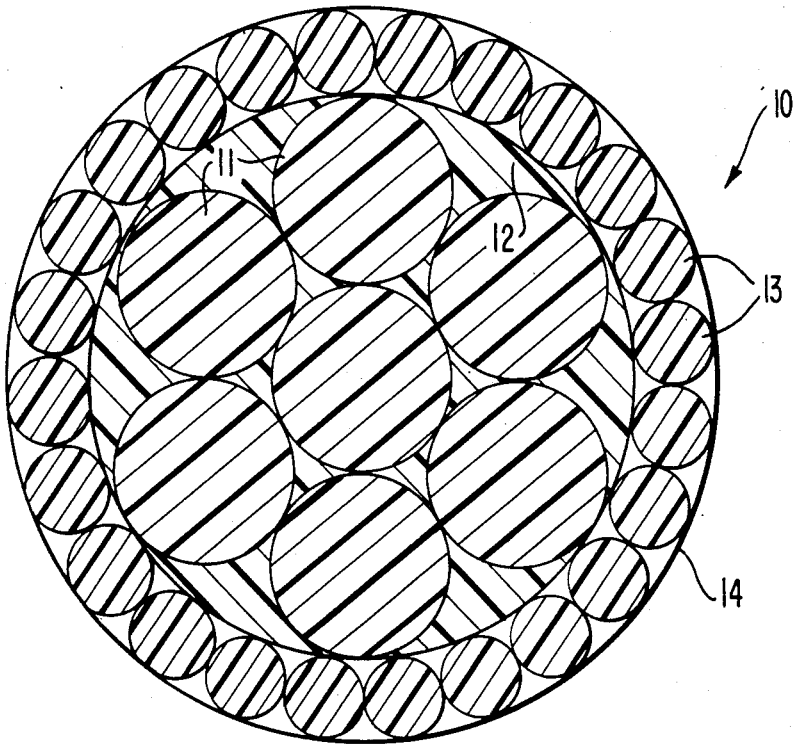
FIG. 1 is a schematic cross-sectional view of the string constructed in accordance with my invention.

Referring now to the drawings and, in particular, to FIG. 1, the string is designated generally by the numeral 10. It will, of course, be readily appreciated that the drawing is not to scale and that the diameter shown in the drawing is greatly exaggerated for illustration purposes only. The string 10 comprises a pseudo-core having seven strands, each designated by the numeral 11 made, for example, of nylon 6 or nylon 66, a resin coating 12 of known composition deposited around the seven strands 12 in a known manner to provide a circular cross-section, a wrapping of thinner fibers 13 around the pseudo-core and finally an outer treatment 14 of known composition (shown schematically) on the surface of the wrapped fibers 13.

Figure 2:
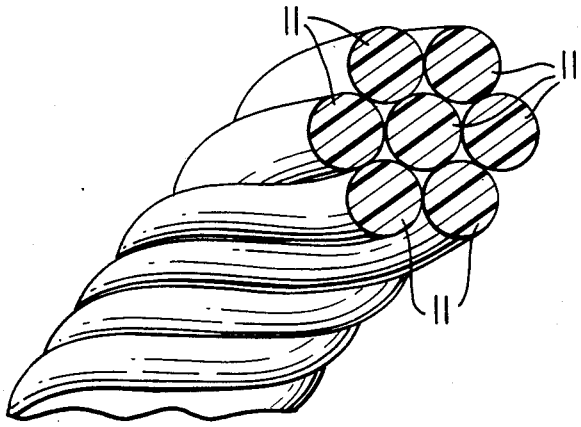
FIG. 2 is a perspective view showing how the seven strand pseudo-core is spirally wound in accordance with my invention.

The process of constructing my improved string consist of four steps. First, a pseudo-core of seven strands 11 is made by twisting together seven monofilament strands 11 of nylon 6, nylon 66 or the like in the manner shown in FIG. 2. The seven strands are then coated or potted with resin 12 as shown in FIG. 1 to make the cross-section of the core circular. It is desirable to use as little resin as possible since resin lowers the tensile strength. The seven strand core minimizes the use of resin and also spaces which can form undesirable voids. The third step involves wrapping about twenty fibers of roughly half the diameter of the strands 11 used in forming the core around the seven strand pseudo-core. The number of the wrapping fibers 13 depends on either the cross-section of the pseudo-core or, alternatively, the total cross-section of the string. I have found that the diameter of the wrapping fibers 13 should be about half the diameter of the strands 11 used in forming the core. A resin shown schematically at 14 in FIG. 1 is then used to treat the outer surface of the wrapped string. The particular resin solution used will depend upon the characteristics sought and the string. One such solution is disclosed in U.S. Pat. No. 3,745,756.

The foregoing structure results in a string having a core with a regular, stable geometrical cross-section and higher straight and knot tensile strength of the core. The seven strand core permits the neighboring fibers to be close to each other while being evenly distributed on a circular circumference. This arrangement also minimizes the use of the resin needed to obtain a circular cross-section and consequently increases the total tensile strength of the string. The even distribution of the strands on the circular circumference also avoids distortion of the core configuration in the manufacturing process. The strands must pass through circular nozzles in the twisting and binding process. If the strands are not evently distributed on the surface, the strands can push each other randomly and distribute themselves unevenly. Using more but thinner strands may help in distributing the outer strands, but the inner ones can be randomly distributed. The seven core strand minimizes the number of strands and achieves even distribution.

As I explained above, the straight and knot tensile strength per unit cross-section generally decreases as the diameter increases when the diameter exceeds a certain range. For nylon fibers, for example, the tensile strengths per unit cross-section decrease dramatically when the diameter exceeds a range over 0.40 to 0.50 mm. In general, the tensile strength per unit cross-section are higher when the diameter is roughly in the range of 0.20 to 0.40 mm. For seven strand cores, the diameter of the core is in the range of 0.93 to 1.10 mm depending upon the guage of the string or, alternatively, the diameter of the strands in the range of 0.31 to 0.36 mm. For instance, if the diameter of the core is 1.00 mm, then the strands should have a diameter of 0.33 mm whereas the straight tensile strength of a seven strand core having a core diameter of 1.00 mm will be approximately the same as the straight tensile strength of a nylon fiber or strand with a diameter of 1.00 mm. The knot tensile strength of the seven core strand having a 1.00 mm diameter will be higher than the knot tensile strength of a nylon strand with a diameter of 1.00 mm. In other words, the knot tensile strength of a seven core strand is appreciably higher than that of a monofilament core.

While I have shown and described one embodiment in accordance with my invention, it will be readily appreciated by one of ordinary skill in the art that changes and modifications may be made thereto without departing from the scope thereof. Accordingly, I do not intend to be limited by the details shown and described herein but intend to cover all changes and modifications as are encompassed by the scope of the appended claims.

I claim:

1. A racket string construction comprising seven contiguous strands of substantially the same diameter, synthetic material deposited around the strands to form a circular cross-section core, and a plurality of wrapping fibers evenly distributed around the circumference of the circular cross-section core, wherein the diameter of each of the wrapping fibers is approximately half the diameter of the strands.

2. A racket string construction according to claim 1, wherein approximately twenty wrapping fibers are distributed around the core.

3. A racket string construction according to claim 1, further comprising a coating around the wrapper fibers.

4. A racket string construction according to claim 1, wherein the strands are made of nylon.

5. A racket string construction according to claim 1, wherein the wrapping fibers are made of nylon.

6. A racket string construction according to claim 1, wherein the synthetic material is a resin which when applied to the strands fills the voids between the strands.

7. A racket string according to claim 1, wherein the number of wrapping fibers varies according to the cross-section of the string.

8. A racket string according to claim 1, wherein the number of wrapping fibers varies according to the cross-section of the core.

9. A racket string according to claim 1, wherein the string has a diameter of between about 1.26 mm and 1.45 mm.

10. A racket string according to claim 1, wherein the strands are spirally wound about the longitudinal axis of the string.

11. A racket string construction comprising seven contiguous strands of substantially the same diameter, synthetic material deposited around the strands to form a circular cross-section core, and a plurality of wrapping fibers evenly distributed around the circumference of the circular cross-section core, wherein the number of wrapping fibers varies according to the cross-section of the string.

12. A racket string construction comprising seven contiguous strands of substantially the same diameter, synthetic material deposited around the strands to form a circular cross-section core, and a plurality of wrapping fibers evenly distributed around the circumference of the circular cross-section core, wherein the number of wrapping fibers varies according to the cross-section of the core.

* * * * *